US007455290B2

(12) United States Patent
Nakashima et al.

(10) Patent No.: US 7,455,290 B2
(45) Date of Patent: Nov. 25, 2008

(54) SHEET FEEDING DEVICE AND IMAGE FORMING APPARATUS USING AN ADJUSTABLE GUIDE MEMBER

(75) Inventors: Akira Nakashima, Kyoto (JP); Toyoaki Nanba, Higashiosaka (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 55 days.

(21) Appl. No.: 11/362,062

(22) Filed: Feb. 27, 2006

(65) Prior Publication Data

US 2006/0191430 A1 Aug. 31, 2006

(30) Foreign Application Priority Data

Feb. 28, 2005 (JP) ..... 2005-053842
Feb. 28, 2005 (JP) ..... 2005-053844

(51) Int. Cl.
*B65H 1/00* (2006.01)

(52) U.S. Cl. ..... 271/171

(58) Field of Classification Search ..... 271/145, 271/171, 220, 223; 399/393; 414/794.3, 414/788.9

See application file for complete search history.

(56) References Cited

U.S. PATENT DOCUMENTS 3,908,980 A * 9/1975 Fowler ..... 271/3.14
4,358,102 A * 11/1982 Hoshizaki et al. ..... 271/164
4,743,945 A * 5/1988 Ito et al. ..... 399/402
4,745,439 A * 5/1988 Hanada et al. ..... 399/124
4,864,368 A * 9/1989 Muramatsu ..... 399/402
4,908,673 A * 3/1990 Muramatsu ..... 399/402
5,327,206 A * 7/1994 Ueda et al. ..... 399/402
5,328,167 A * 7/1994 Frank ..... 271/241
5,510,909 A * 4/1996 Morikawa et al. ..... 358/498
5,634,634 A * 6/1997 Dobbertin et al. ..... 271/3.02
5,697,298 A * 12/1997 Greive et al. ..... 101/232
6,010,124 A * 1/2000 Higashikawa et al. ..... 271/3.02
6,015,144 A 1/2000 Yoshii et al.
6,073,925 A * 6/2000 Sato ..... 271/171
6,257,570 B1 * 7/2001 Ficyk ..... 271/148
6,302,606 B1 * 10/2001 Hayakawa et al. ..... 400/625
6,435,499 B1 * 8/2002 Tomatsu ..... 271/147

(Continued)

FOREIGN PATENT DOCUMENTS

JP 61-75745 A 4/1986

(Continued)

*Primary Examiner*—Patrick Mackey
*Assistant Examiner*—Gerald W McClain
(74) *Attorney, Agent, or Firm*—Birch, Stewart, Kolasch & Birch, LLP

(57) ABSTRACT

A sheet feeding device is adapted to feed a sheet to a sheet processing apparatus. The sheet feeding device has a stacking plate, a first guiding member, and an angle adjustment mechanism. The stacking plate is adapted for sheets to be stacked thereon. The first guiding member is adapted to move on the stacking plate along a width dimension thereof perpendicular to a sheet feeding direction. The first guiding member is also adapted to rotate around a vertical axis. The first guiding member has a vertical guiding surface for positioning the sheets disposed on the stacking plate. The angle adjustment mechanism is adapted to rotate the guiding member around the vertical axis, for slanting the guiding member with the vertical guiding surface at an angle with the sheet feeding direction.

15 Claims, 10 Drawing Sheets

U.S. PATENT DOCUMENTS

| | | | | |
|---|---|---|---|---|
| 6,543,763 | B2 * | 4/2003 | Ito et al. | 271/178 |
| 6,659,451 | B2 * | 12/2003 | Kim | 271/145 |
| 2003/0151188 | A1 * | 8/2003 | Imahara | 271/171 |
| 2006/0087072 | A1 * | 4/2006 | Kwon et al. | 271/171 |

FOREIGN PATENT DOCUMENTS

| | | | | |
|---|---|---|---|---|
| JP | 61075745 | A | * | 4/1986 |
| JP | 1-76831 | U | | 5/1989 |
| JP | 7-187408 | A | | 7/1995 |
| JP | 11-5643 | A | | 1/1999 |
| JP | 11-208902 | A | | 8/1999 |
| JP | 11-334889 | A | | 12/1999 |
| JP | 2000-44077 | A | | 2/2000 |
| JP | 2000044077 | A | * | 2/2000 |
| JP | 2000-344355 | A | | 12/2000 |

* cited by examiner

SHEET FEEDING DEVICE AND IMAGE FORMING APPARATUS USING AN ADJUSTABLE GUIDE MEMBER

CROSS REFERENCE

This Nonprovisional application claims priority under 35 U.S.C. § 119(a) on Patent Application No. 2005-053842 filed in Japan on Feb. 28, 2005, and Patent Application No. 2005-053844 filed in Japan on Feb. 28, 2005, the entire contents of which are hereby incorporated by reference.

BACKGROUND OF THE INVENTION

The present invention relates to sheet feeding device for feeding a sheet to a sheet processing apparatus, and a sheet processing apparatus provided with such sheet feeding device.

Sheet processing apparatuses, which perform a predetermined sheet processing operation, are supplied sheets from sheet feeding devices. Sheet feeding devices, generally, are configured to deal with sheets of different sizes. For example, there are sheet feeding devices having a movable guiding members adapted to position sheets disposed in the sheet feeding devices. The guiding members include a guiding member adapted to position rear edges of sheets, and a guiding member adapted to position side edges of sheets. In particular, JP H11-208902A discloses a sheet feeding device, having a movable guiding member, adapted to move the guiding member in accordance with sheet size.

However, such conventional sheet feeding devices involve a potential problem that friction between moving sheets and the guiding member may cause sheets to be damaged. As the friction force become stronger, the sheets are more likely to be damaged.

A feature of the invention is to provide a sheet feeding device that has simplified construction adapted to protect sheets from being damaged by friction with guiding members.

SUMMARY OF THE INVENTION

A sheet feeding device is adapted to feed a sheet to a sheet processing apparatus. The sheet feeding device has a stacking plate, a first guiding member, and an angle adjustment mechanism. The stacking plate is adapted for sheets to be stacked thereon. The sheets are to be fed into the sheet processing apparatus. The first guiding member is adapted to move on the stacking plate along a width dimension thereof perpendicular to a sheet feeding direction. The first guiding member is also adapted to rotate around a vertical axis. The first guiding member has a vertical guiding surface for positioning the sheets disposed on the stacking plate. The angle adjustment mechanism is adapted to rotate the guiding member around the vertical axis, for slanting the guiding member with the vertical guiding surface at an angle with the sheet feeding direction.

When the guiding surface slants to the sheets, contact area between the guiding surface and the sheets is reduced, accordingly friction between the guiding surface and the sheets is reduced.

DETAILED DESCRIPTION OF THE INVENTION

Figure 1:
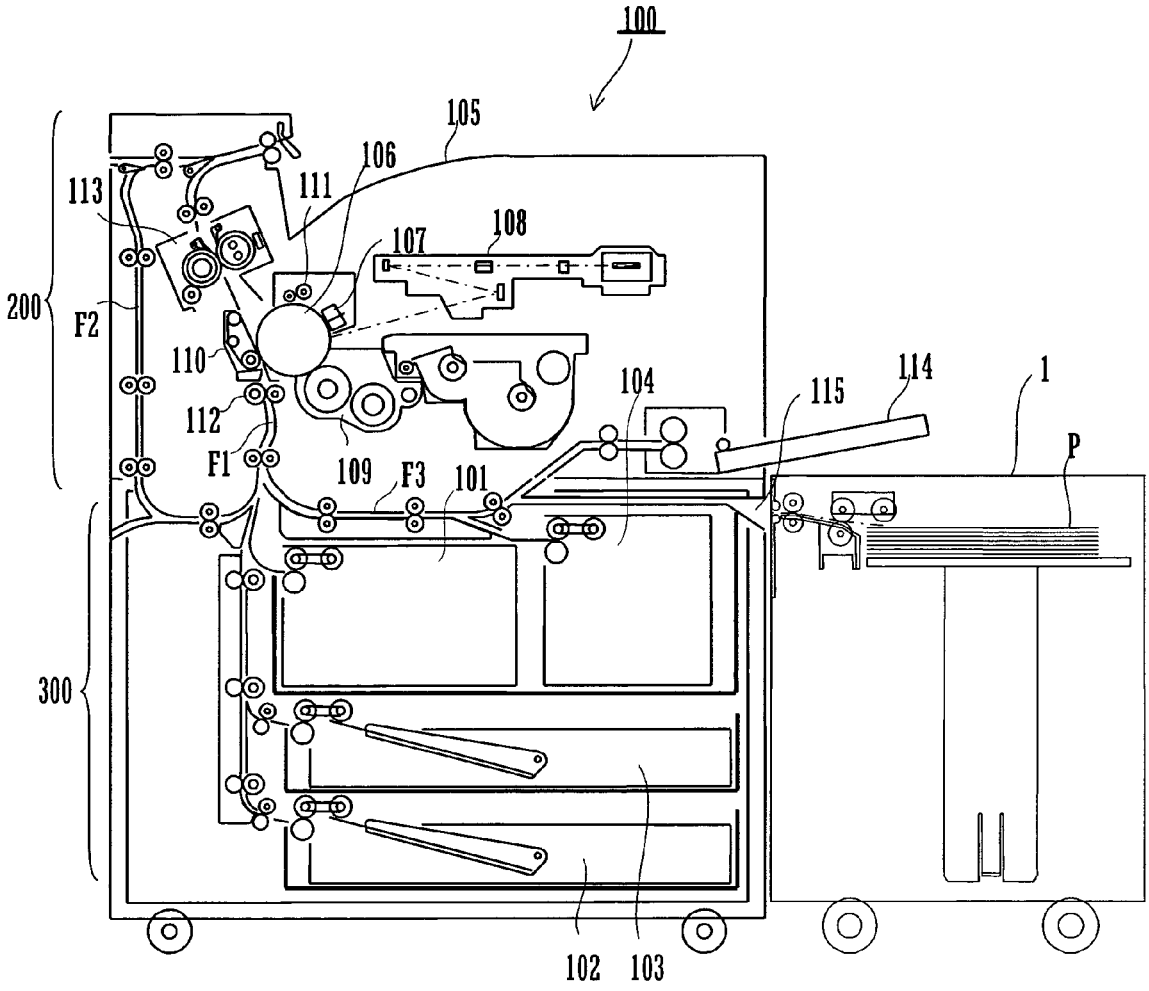
FIG. 1 is a schematic cross-sectional view of an image forming apparatus as a sheet processing apparatus, and a LCC (Large Capacity Cassette) as a sheet feeding device.

FIG. 1 illustrates a schematic construction of an image forming apparatus 100 and an LCC 100. The LCC 1 is arranged beside the image forming apparatus 100. The LCC 1 is adapted to supply sheets of paper to the image forming apparatus 100 through a sheet receiving section 115. In the embodiment, the LCC 1 is capable of storing approximately 5000 sheets of various sizes such as A3-size, B4-size, A4-size, and B5 size.

The image forming apparatus 100 has an image forming section 200 that is adapted to form an image on a sheet by performing an electrophotographic image forming process. The image forming apparatus 100 is provided with a sheet feeding section 300 that has sheet cassettes 101 to 104 below the image forming section 200. The image forming apparatus 100 is also provided with a manual feeding tray 114, on a side surface thereof, for feeding sheets of various sizes. In addition, the image forming apparatus 100 is provided with a sheet output tray 105 above the image forming section 200.

There is provided with a sheet transport path F1 adapted to lead to the sheet output tray 105 from the sheet cassettes 101 to 103. Close to the sheet transport path F1, there is provided with a photoreceptor drum 106. Around the photoreceptor drum 106 arranged are a charging device 107, an optical scanning unit 108, a developing unit 109, a transferring device 110, a cleaning unit 111.

Registration rollers 112 are provided upstream of the photoreceptor drum 106 in the sheet transport path F1. The registration rollers 112 are adapted to feed the sheet into an area between the photoreceptor drum 106 and the transferring device 110 in a timely manner.

There is provided a fusing device 113 downstream of the photoreceptor drum 106 in the sheet transport path F1. The charging device 107 is adapted to apply a predetermined level of electrostatic charge to a circumferential surface of the photoreceptor drum 106.

The optical scanning unit 108 is adapted to form an electrostatic latent image on the circumferential surface of the photoreceptor drum 106 based on image data. The developing unit 109 is adapted to supply toner to the circumferential surface of the photoreceptor drum 106, thereby forming a toner image on the photoreceptor drum 106. The transferring device 110 is adapted to transfer the toner image as formed on the circumferential surface of the photoreceptor drum 106 to the sheet. The fusing device 113 is adapted to fix the toner image onto the sheet. The cleaning unit 111 is adapted to remove and collect residual toner that remains on the circumferential surface after the transfer operation is completed. The sheet with the toner image fixed thereto is output to the sheet output tray 105.

Figure 2:
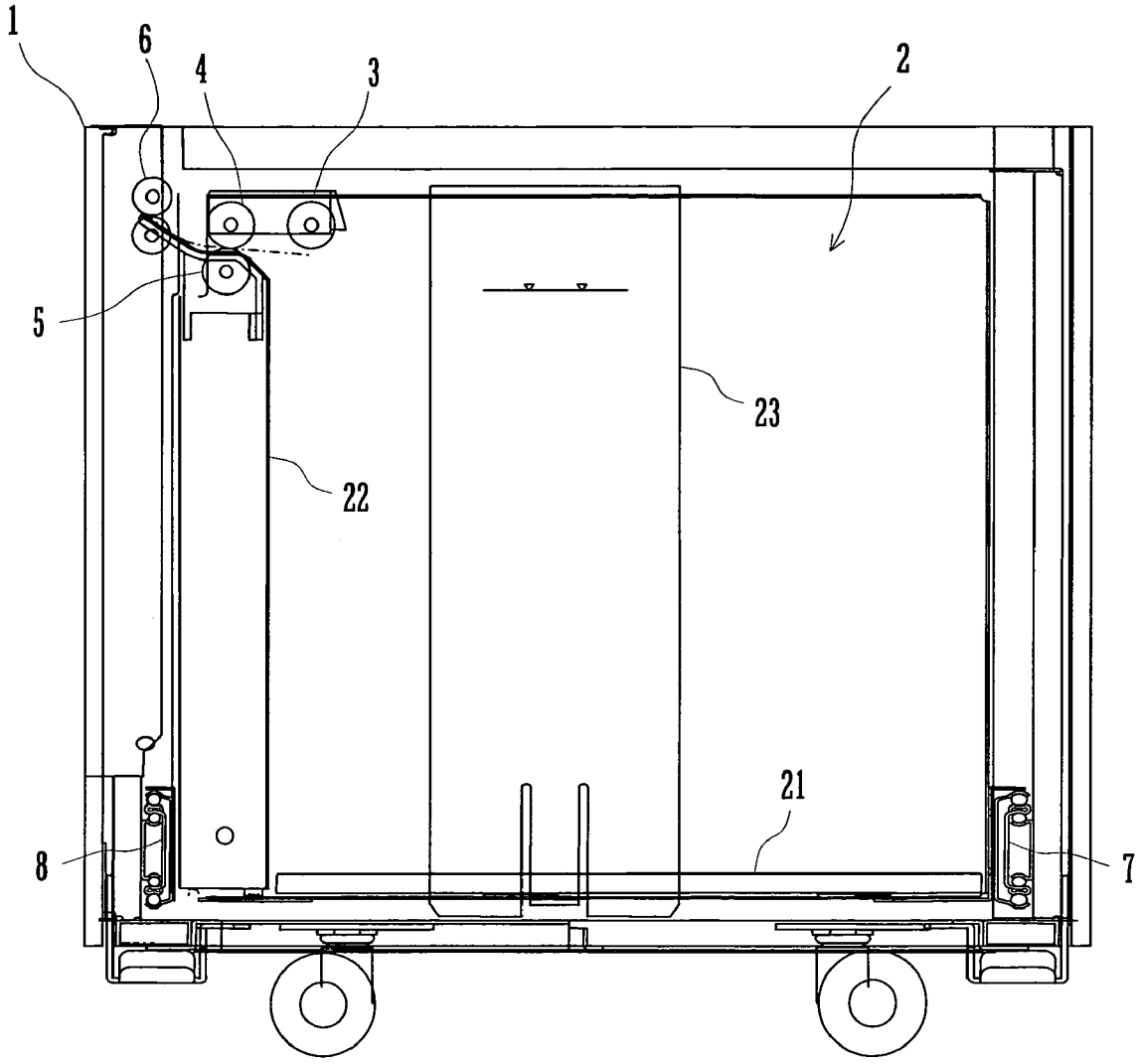
FIG. 2 is a schematic front cross-sectional view of the LCC.

The image forming apparatus 100 is also provided with a switchback transport path F2 and a sheet transport path F3. The switchback transport path F2 is adapted, in a double-sided image forming process in which an image is formed on each side of the sheet, to transport thereon the sheet from an area downstream of the fusing device 113 to an area upstream of the registration rollers 112 in the sheet transport path F1. The sheet transport path F3 is adapted to transport thereon sheets fed from each of the sheet cassette 104, a manual feeding tray 114, and the LCC 1 to junction of the sheet transport paths F1 and F3. FIG. 2 is a front cross-sectional view illustrating a construction of the LCC 1. The LCC 1 has a housing 9. The housing 9 is provided with a sheet stacker 2, a pick-up roller 3, a sheet feeding roller 4, a reversing roller 5, and transporting rollers 6 thereinside. The sheet stacker 2 has a stacking plate 21, a front guiding plate 22, side guiding plates 23 and 24, and a rear guiding plate. The side guiding plate 24 and the rear guiding plate are not shown in FIG. 2. The sheet stacker 2 is mounted slidably on the housing 9 in such a manner that the sheet stacker 2 can be pulled out forward.

There are provided slide rail assemblies 7 and 8 close to the sheet stacker 2. The slide rail assemblies 7 and 8 are mounted on the sheet stacker 2 with its longitudinal axis perpendicular to surface of FIG. 2. The slide rail assemblies 7 and 8 are adapted to enable the sheet stacker 2 to slide along the longitudinal axis.

A plurality of sheets are stacked on the stacking plate 21 that is held horizontally. The sheets as stacked are positioned with the front guiding plate 22, the side guiding plates 23 and 24, and the rear guiding plate.

The pick-up roller 3 is supported so as to be pivotable about a rotary shaft for the sheet feeding roller 4, between an upper position and a lower position. The pick-up roller 3 is adapted to pick up a top one of the sheets stacked on the stacking plate 21 and lead the top sheet between the sheet feeding roller 4 and the reversing roller 5. The sheet feeding roller 4 and the reversing roller 5 are both rotated clockwise in FIG. 2. The reversing roller 5 is adapted to be supplied driving force through a torque limiter.

In a case where multiple sheets are picked up at a time and led between the rollers 4 and 5 by the roller 3, only a top one of the sheets are brought into contact with the roller 4 and led to the transporting rollers 6. The rest of the sheets are returned to the stacking plate 21 by the reversing roller 5.

The side guiding plates 23 and 24 are adapted to move on the stacking plate 21 within a predetermined range from frontward to rearward, and vice versa, of the LCC 1. More specifically, the plates 23 and 24 are movable along a horizontal axis perpendicular to a sheet feeding direction.

The side guiding plates 23 and 24 are connected to each other through a rack and pinion gears mechanism. More specifically, the side guiding plates 23 and 24 are connected to first and second rack gears respectively, and the first and second rack gears are both meshed with a pinion gear. Thus, as the side guiding plate 23 moves in a first direction along the horizontal axis, the side guiding plate 24 moves in a second direction opposite to the first direction.

In addition, the rear guiding plate is adapted to move on the stacking plate 21 in the sheet feeding direction and the opposite direction within a predetermined range.

The LCC 1 is provided with a lifting motor, wires, and pulley wheels. The wires transmit a driving force from the lifting motor to the stacking plate 21. The pulley wheels sustain the wires. Rotation of the lifting motor is transmitted through the wires, thereby lifting the stacking plate 21 up and down along a not-shown vertical guiding shaft while the plate 21 is being held in a horizontal position.

Figure 3:
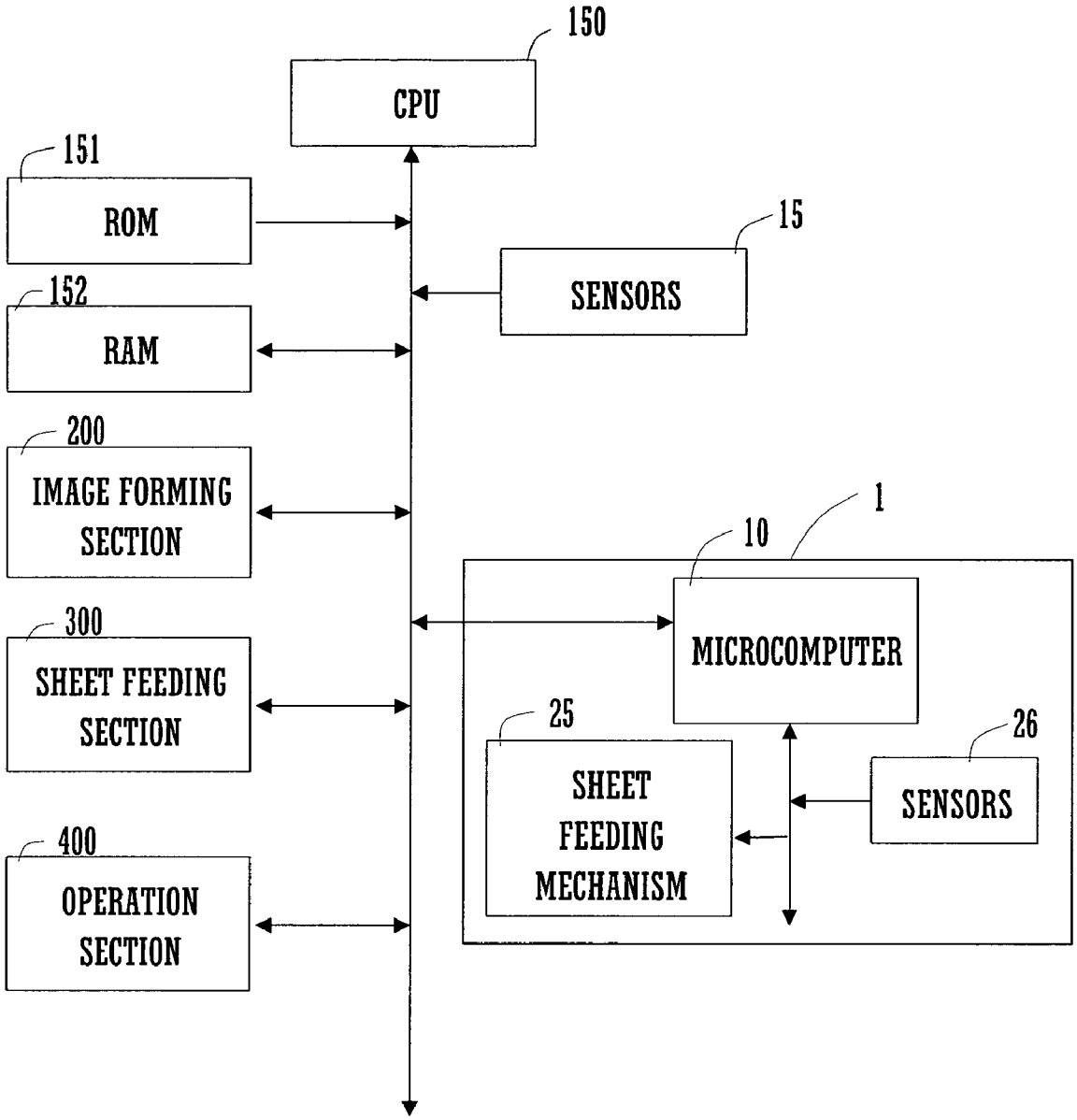
FIG. 3 is a block diagram illustrating a schematic construction of the image forming apparatus and the LCC.

FIG. 3 is a block diagram illustrating a schematic construction of the image forming apparatus 100. The image forming apparatus is provided with a CPU 150, a ROM 151, a RAM 152, the image forming section 200, the sheet feeding section 300, an operation section 400, and sensors 15. The CPU 150 controls all the other parts of the image forming apparatus 100. The ROM 151 contains instructions or data necessary for the image forming apparatus 100 to operate. The RAM 152 is a volatile memory for storing data temporarily.

The operation section 400 is provided with a operation panel that is adapted to receive an operator's instruction, and a liquid crystal display (or merely LCD) that is adapted to provide information to an operator.

The sensors 15 include sensors adapted to detect sheet feeding movements along the sheet transport path F1 to F3 respectively. The sensor 15 also includes a sensor adapted to detect whether a sheet is present in the sheet feeding section 300.

The LCC 1 is provided with a sheet feeding mechanism 25, sensors 26, and a microcomputer 10. The sheet feeding mechanism 25 is configured to feed a sheet disposed inside the LCC 1 to the image forming apparatus 100 through the sheet receiving section 115 in accordance with signals from the image forming apparatus.

The sensors 26 is configured to detect whether a sheet is present in the LCC 1, what size are sheets inside the LCC1, whether a problem occurs during sheet feeding process. The microcomputer 10 controls all the other parts of the LCC 1. The microcomputer 10 is configured to communicate with the CPU 150.

Figure 4A:
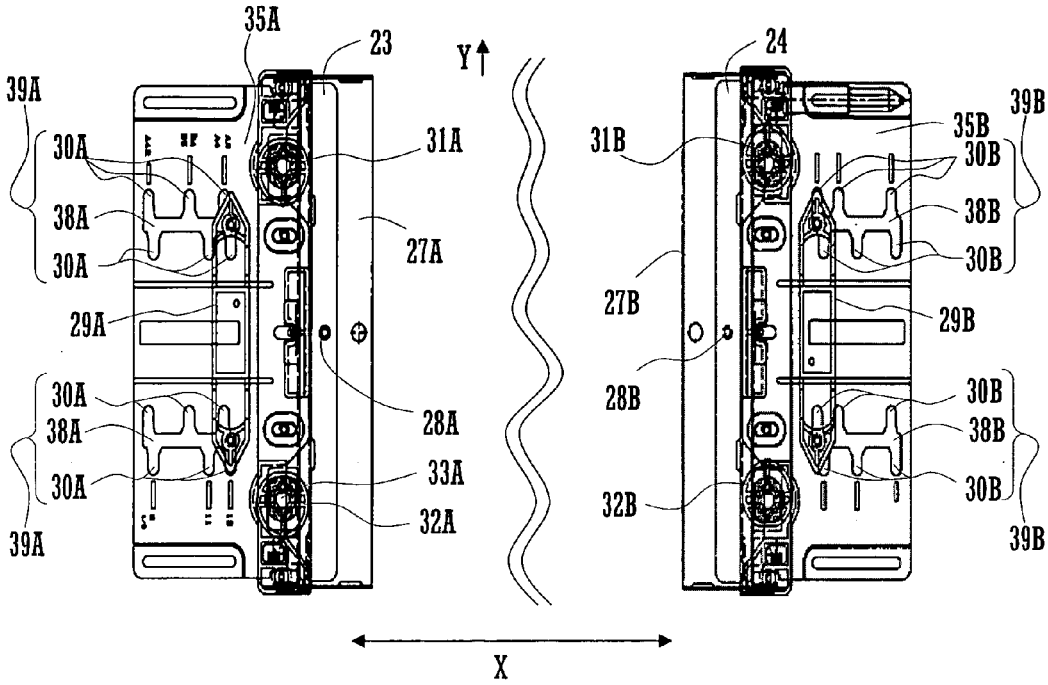
FIGS. 4A and 4B are plan views illustrating configurations of the side guiding plates.
Figure 4B:
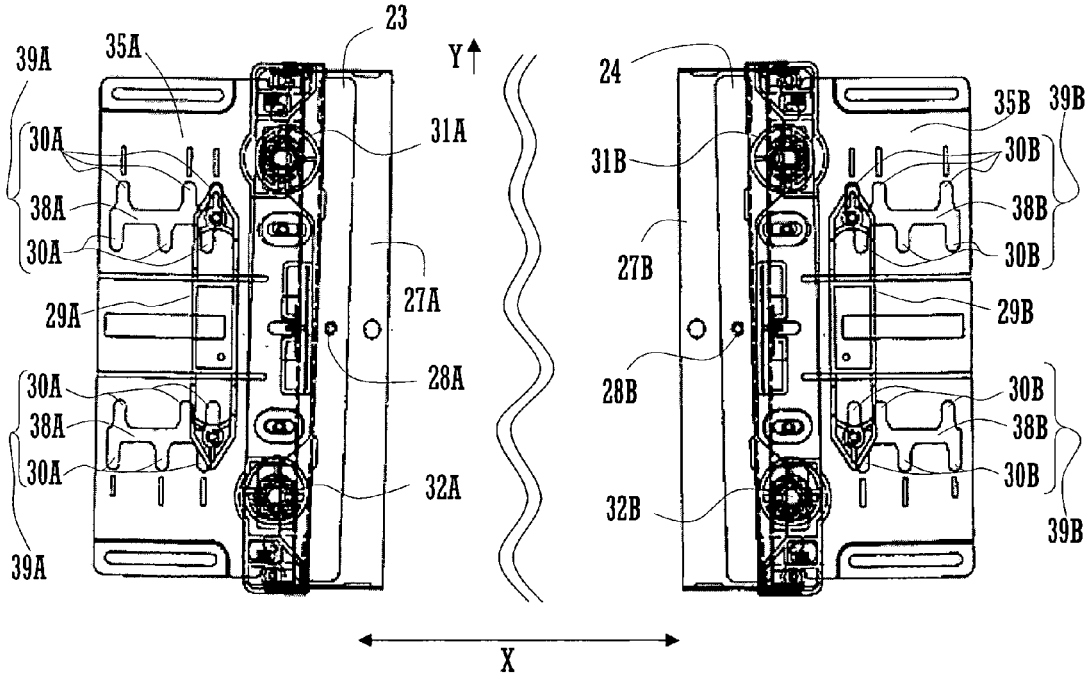

FIGS. 4A and 4B are plan views illustrating configurations of the side guiding plates 23 and 24. FIG. 4A illustrates the side guiding plates 23 and 24 being placed parallel to each other. FIG. 4B illustrates the side guiding plates 23 and 24 being placed virtually parallel to each other with a distance between the plates 23 and 24 gradually narrower in the sheet feeding direction.

The side guiding plate 23 is mounted on a base 27A movable along a width dimension indicated by an arrow X perpendicular to the sheet feeding direction. And the side guiding plate 24 is mounted on a base 27B movable along the width dimension.

There are provided horizontal upper plates 35A and 35B above the bases 27A and 27B respectively. The upper plates 35A and 35B facing to the bases 27A and 27B respectively.

Figure 5A:
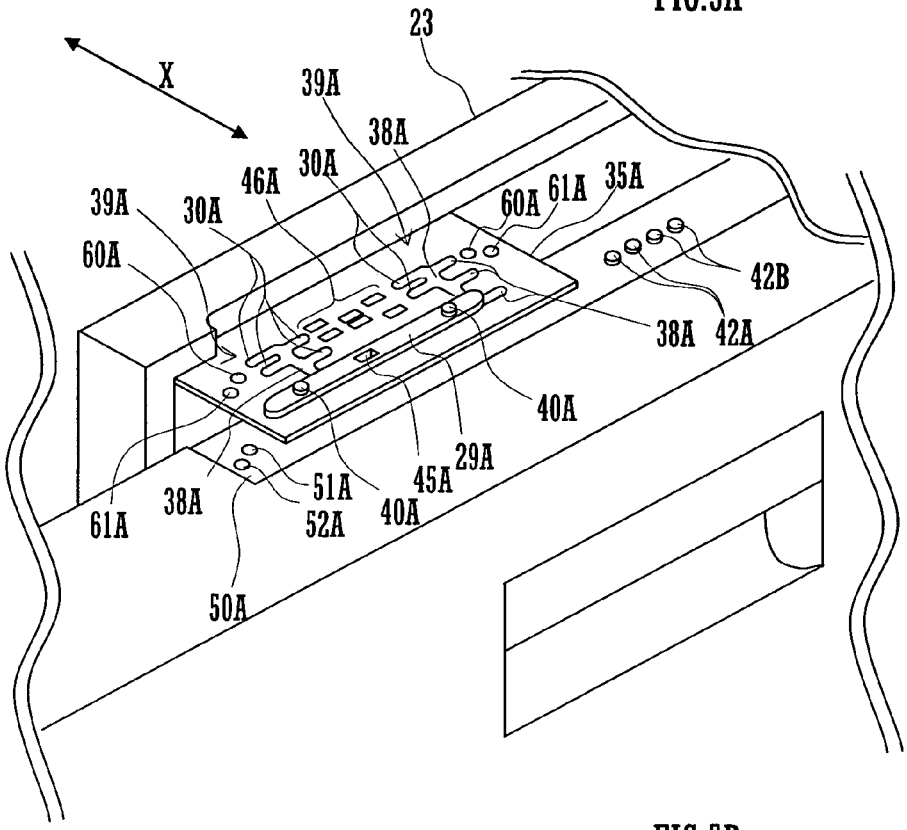
FIG. 5 is a perspective view of a positioning mechanism and an auxiliary positioning mechanism.
Figure 5B:
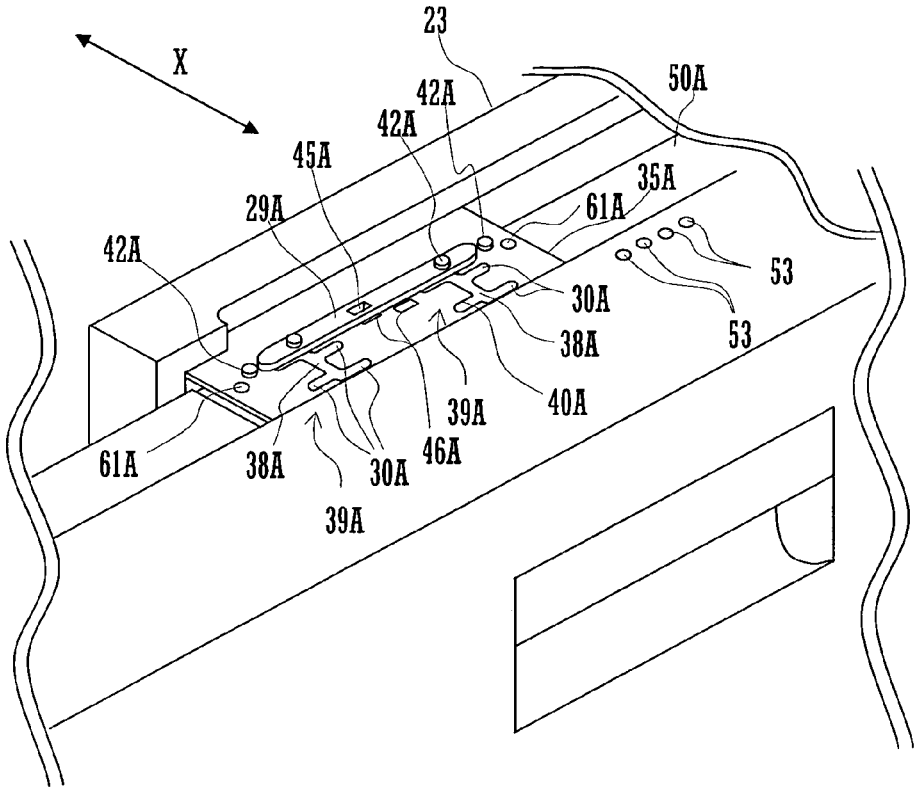

The horizontal upper plate 35A, as illustrated in FIGS. 5A and 5B, is secured to upper portion of the side guiding plate 23. The side guiding plate 23 is positioned in the width dimension by a positioning mechanism such as the horizontal upper plate 35A, pins 40A, and a lock plate 29A. The horizontal upper plate 35A has two opening portions 39A each including an elongated opening 38A and a plurality of holes 30A.

A plurality of holes 30A are adapted to engage with the lock plate 29A. The side guiding plate 24 is positioned in the width dimension by engagement between the horizontal upper plate 35B and a positioning member 29B. Each one of the holes 30A is connected to the elongated opening 38A.

The lock plate 29A engages with top portions of pins 40A. The pins 40A are inserted into the opening portions 39A respectively, and secured at bottom portions to a frame 50A of the LCC 1. The lock plate 29A and the frame 50A hold the upper plate 35A therebetween in such a manner that the upper plate 35A is movable horizontally.

The pins 40A are adapted to move in the opening portions 39A respectively in accordance with movement of the upper plate 35A and to engage with any one of the holes 30A. Thus, the side guiding plates 23 is positioned in the width dimension by engagement between the pins and the respective holes 30A.

There are provided a plurality of display plates 46A on the upper plate 35A in predetermined locations. Each one of the display plates 46A shows corresponding one of sizes of standard sheets.

The lock plate 29A has a rectangular opening 45A therethrough. The rectangular opening 45A is placed on one of the display plates 46A when the pins 40A engage with one of the holes 30A thereby ensuring that operator can know size of the sheets by seeing one of the display plates 46A through the rectangular opening 45A.

For example, when the pins 40A engage with the holes 30A corresponding to standard sheets of A4R size, the display plate 46A indicating "A4R" is visible through the rectangular opening 45A. Accordingly, an operator notices what sizes are the sheets disposed on the plate 21, thereby ensuring that positioning of the side guiding plate 23 is performed with ease.

The upper plate 35A is further provided with two auxiliary tooling holes 60A and two auxiliary tooling holes 61A. The tooling holes 60A is used for positioning the side guiding plate 23 at a location corresponding to a first auxiliary standard sheet such as "kiku" (kiku ¼: 318 mm ×469 mm". The tooling holes 61A is used for positioning the side guiding plate 23 at a location corresponding to a second auxiliary standard sheet such as "A-ban ¼" (312 mm×440 mm).

For example, the guiding plate 23 can be positioned in a position corresponding to the first auxiliary standard sheet by moving the upper plate 35A to a position in such a manner that the opening 45A is placed right on the display plate indicating "kiku" (kiku ¼: 318 mm×469 mm".

When the upper plate 35A is placed in the position, the holes 60A is disposed right on lock holes 51A. This allows stepped pins 42A to be secured to the lock holes 51A through the holes 60A.

When the upper plate 35A is placed in a position corresponding to the second auxiliary standard sheet, the holes 61A is disposed right on lock holes 52A. This allows stepped pins 42A to be secured to the lock holes 52A through the holes 61A.

When the guiding plate 23 is positioned in a location corresponding to the first auxiliary standard sheet or the second auxiliary standard sheet, the pins 40A is placed in the elongated opening 38A.

The upper plate 35A, the lock plate 29A, and the stepped pins 42A are corresponding to an auxiliary positioning mechanism of the invention.

The holes 60A and 61A allow the LCC to store auxiliary standard sheets that is less frequently used, with a simplified construction.

A basic structure of the guiding plate 24 is similar to that of the guiding plate 23.

In addition, the stepped pins 42A, as well as stepped pins 42B that are used for positioning the guiding plate 24, are adapted to be secured to holes 53 when not in use for positioning. Such construction prevents the stepped pins 42A and 42B from being lost.

Further, the side guiding plate 23 is adapted to rotate about a vertical axis 28A, and the side guiding plate 24 is adapted to rotate about a vertical axis 28B. Accordingly, such construction allows the side guiding plates 23 and 24 to make an angle with the sheet feeding direction.

An angle between the side guiding plate 23 and the sheet feeding direction is adjusted by rotating knobs 31A and 32A. An angle between the side guiding plate 24 and the sheet feeding direction is adjusted by rotating knobs 31B, 32B.

Described below is how the angle of the side guiding plate 23 is adjusted by the movement of the knob 32A. In addition, constructions of the knobs 31A, 31B, 32B are similar to that of the knob 32A, and explanations of knobs 31A, 31B, 32B are thus omitted.

Figure 6:
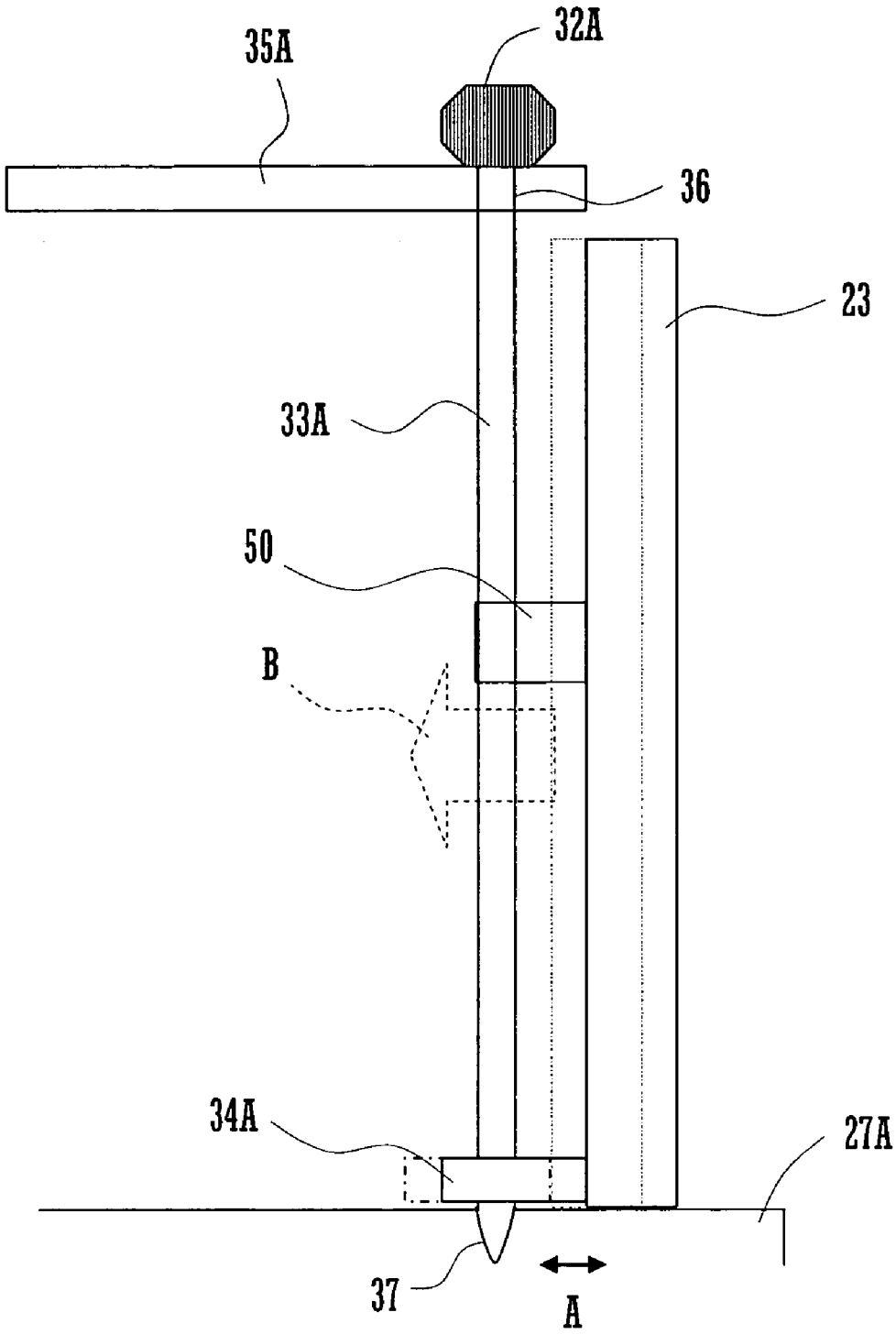
FIG. 6 is a schematic diagram of the guiding plate.

FIG. 6 illustrates a schematic diagram of the guiding plate 23. As shown in FIG. 6, the knob 32A is secured to a top portion of a vertical rotary shaft 33A. The rotary shaft 33A is supported rotatably with a top portion thereof supported by a hole 36 in the upper plate 35A, and with a bottom portion thereof supported by a recess 37 in the base plate 27A.

There is provided an eccentric cam 34A secured to the rotary shaft 33A. The eccentric cam 34A has a profile adapted to make sliding contact with the guiding plate 23. The cam 34A abuts on a surface of the guiding plate 23, the surface being opposite to a guiding surface of the guiding plate 23. The guiding plate 23 is urged in a direction shown as an arrow B by a rubber belt 50. The rubber belt 50 is secured to the rotary shaft 33A and the guiding plate 23.

In addition, other elastic member such as a spring is applicable as an urging member of the invention, instead of the rubber belt 50. The guiding plate 23 is positioned by contact between the guiding plate 23 and the cam 34A. Thus, locations of edges of the guiding plate 23 are adjustable in a predetermined range shown as an arrow A, by rotating the knobs 31A and 32A. Accordingly, the angle of the guiding plate 23 is adjusted by rotating the knobs 31A and 32A.

Figure 7A:
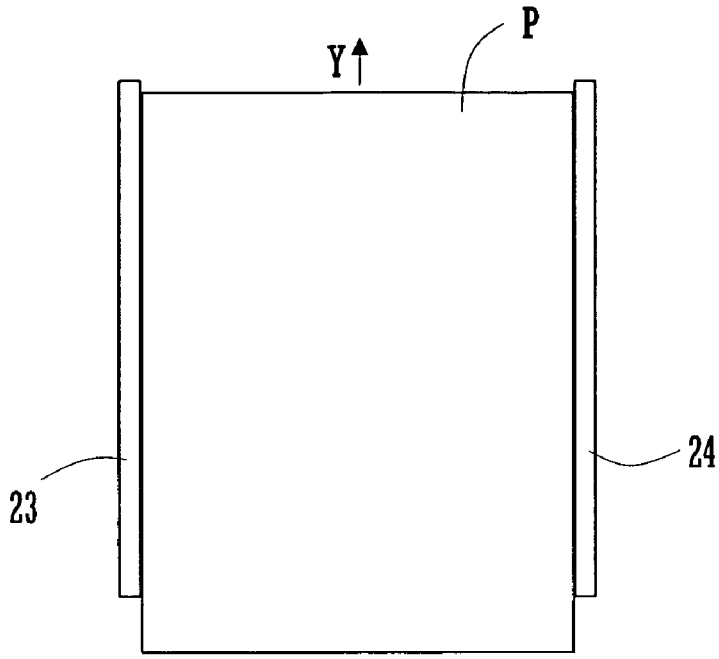
FIGS. 7A and 7B are schematic diagrams of the guiding plates.
Figure 7B:
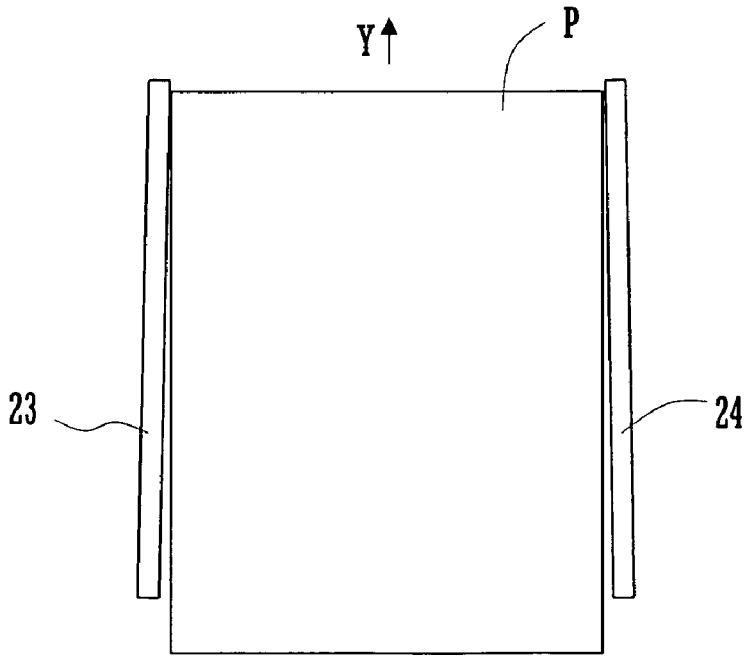

FIGS. 7A and 7B are schematic diagrams of the guiding plates 23, 24. As illustrated in FIG. 7A, the guiding plates 23 and 24 are normally placed in parallel to each other. A sheet is transported in a sheet feeding direction shown as an arrow Y, being in contact with the guiding plates 23, 24.

When the guiding plates are parallel to each other, relatively large standard sheets such as A3 and B4 sheets are transported being in contact with the guiding plates 23, 24 at entire length thereof. Thus, friction between such sheets and the guiding plates 23,24 may become so strong that the sheets are damaged by the friction while being transported.

In order to protect the sheets from the damage, the first embodiment employs a construction that allows contact area between the guiding plate 23 and the sheets as well as between the guiding plate 24 and the sheets to reduce by adjusting the angles of the guiding plates 23 and 24.

Thus, the sheets are unlikely to be damaged by the friction. Further, down stream portions of the guiding plates 23 and 24 in the sheet feeding direction, prevent the sheets from getting skewed while being transported.

Described below is a second embodiment of the invention. An LCC in the second embodiment has a basic construction similar to that of the LCC 1 in the first embodiment. The LCC employs guiding plates 23' and 24' instead of the guiding plates 23 and 24.

Figure 8A:
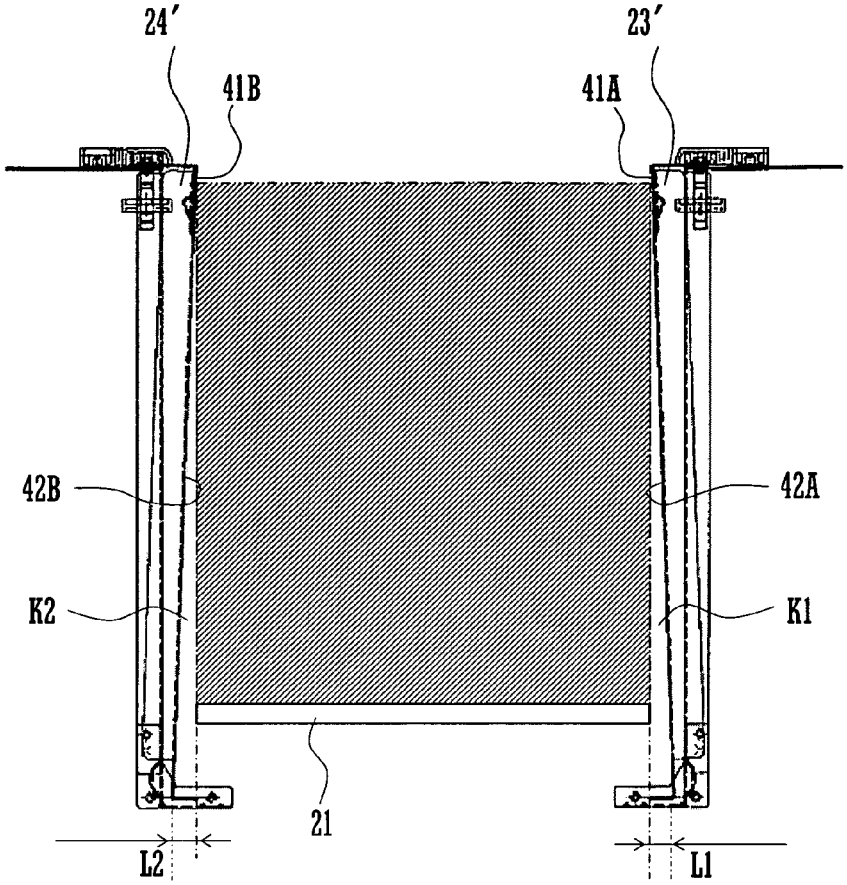
FIGS. 8A and 8B are sectional views of the guiding plate.
Figure 8B:
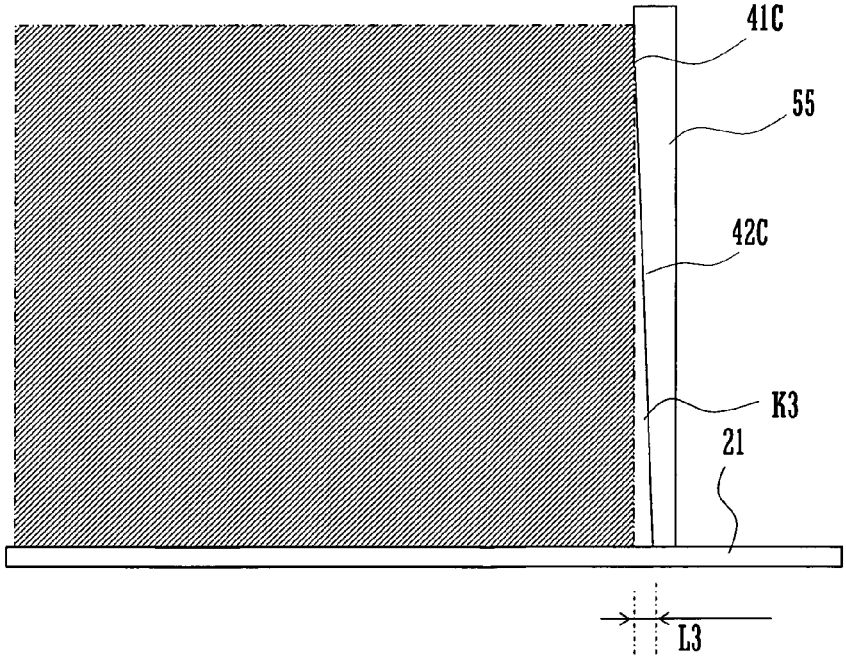
Figure 9:
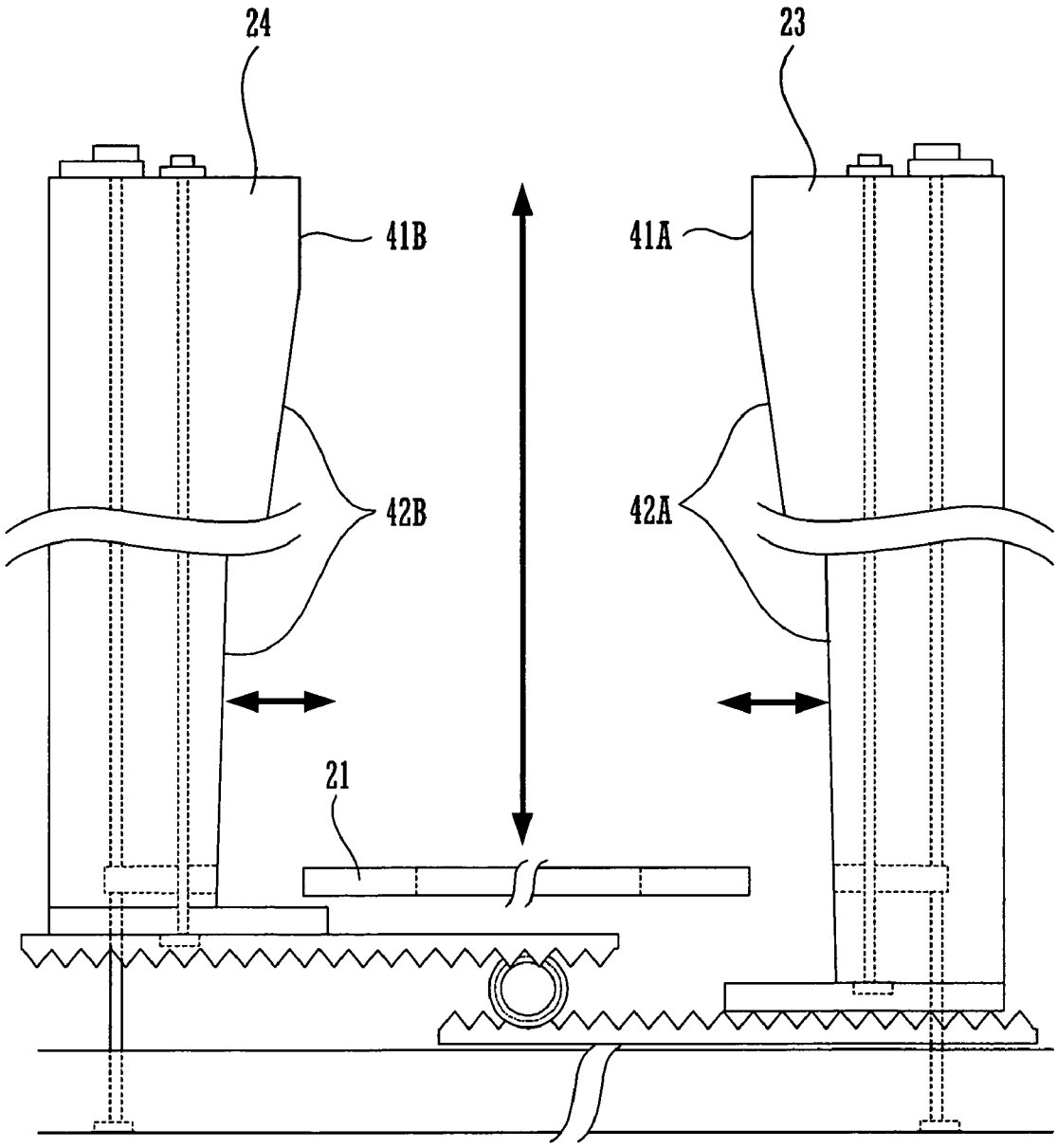
FIG. 9 is a sectional view of the guiding plate.

FIGS. 8 and 9 illustrate sectional views of the guiding plate 23' and 24'. As illustrated in FIG. 9, the guiding members 23' and 24' are secured to a first rack gear and a second rack gear respectively, and the first rack gear and the second rack gear are connected to each other through a pinion gear meshed with both of the first and second rack gear.

The guiding plate 23' is provided with a vertical portion such as a vertical surface 41A and a slant portion such as a slant surface 42A, at a side facing the sheet. The vertical surface 41A is disposed at a top potion of the guiding plate 23'.

The vertical surface 41A has a vertical dimension approximately equal to a vertical movable range of the pickup roller 3 at sheet feeding operations. Examples of the vertical movable range include, but are not limited to, a thickness of 30 to 50 sheets. The vertical surface 41A adapted to position sheets at sheet feeding area. The slant surface 42A extends from the vertical surface 41A to the bottom edge of the guiding plate 23'. The slant surface 42A is disposed in such a manner that a distance between the slant surface 42A and the sheets increase downward. A distance between the slant surface and the sheets at the bottom, illustrated as an arrow L1, is 2 to 3 mm.

The guiding plate 23' and the guiding plate 24' are symmetrical. The guiding plate 24' has a vertical portion such as a vertical surface 41B and a slant portion such as a slant surface 42B. The slant surface 42B is disposed in such a manner that a distance between the guiding plate 24' and the sheets increases downward up to 2 to 3 mm at the lowest point. In addition, it is preferable to provide to a rear guiding plate a slant surface similar to the slant surface 42A. In the second embodiment, the LCC employs a rear guiding plate 55' as illustrated in FIG. 8B. The rear guiding plate 55' has a vertical portion such as a vertical surface 41C and a slant portion such as a slant surface 42C. The slant surface 42C is disposed in such a manner that a distance between the rear guiding plate 55' and the sheets increases downward up to 2 to 3 mm at the lowest point.

FIGS. 10A to 10D are schematic diagrams of movement of the stacking plate 21. A sheet stacker 2 is provided with a first sheet detect sensor 31, a plate detect sensor 32, and a second sheet detect sensor 33.

The first sheet detect sensor 31 is adapted to detect sheets on the plate 21 at lower parts of a sheet feeding area corresponding the vertical surfaces 41A to 41C.

Figure 10A:
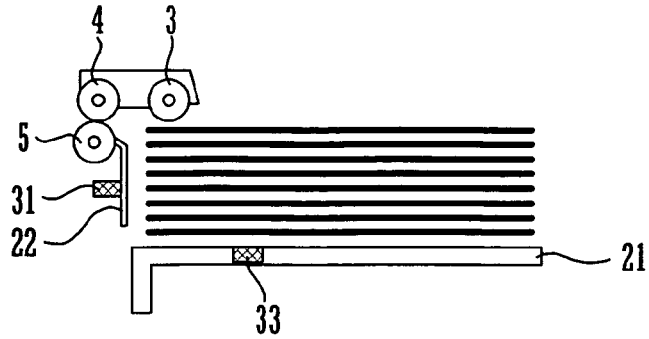
FIGS. 10A to 10D are schematic diagrams of movement of the stacking plate.
Figure 10B:
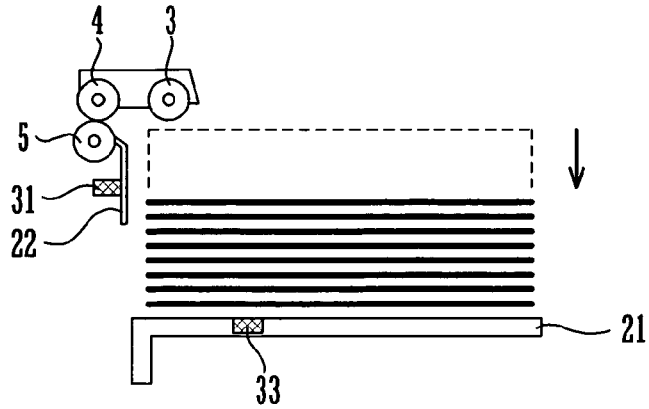

The LCC is provided with a microcomputer 10'. The microcomputer 10', upon the detection of the sheets by the first sheet sensor 31, moves the plate 21 downward until the first sheet sensor 31 does not detect the sheets as shown in FIGS. 10A and 10B.

Figure 10C:
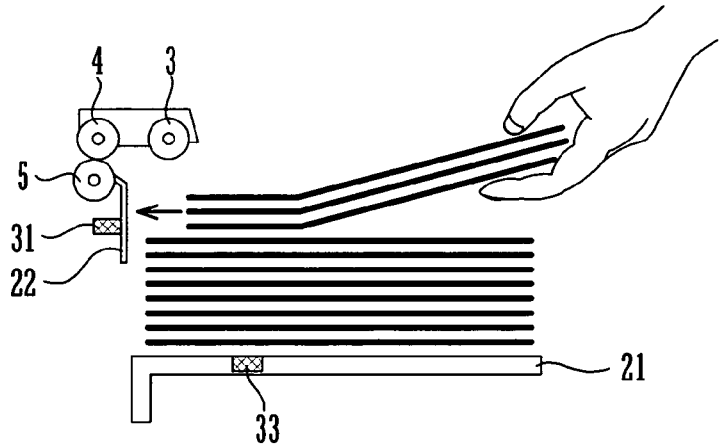
Figure 10D:
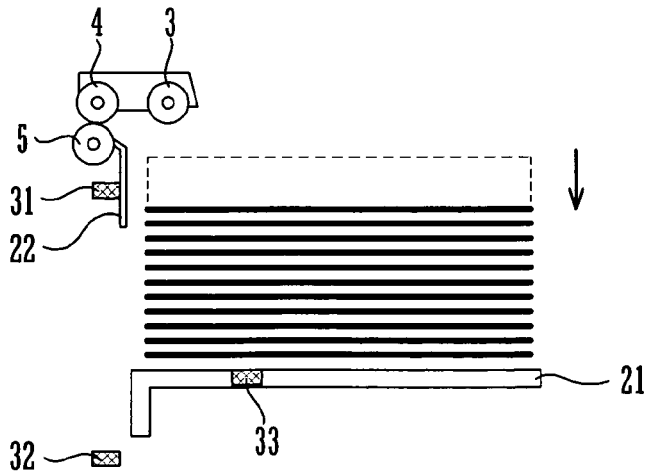

Descent of the plate 21 makes a space for sheet replenishment. Replenished sheets are positioned by a front guiding plate 22 and the vertical surfaces 41A to 41C. If the first sheet detect sensor detects sheets after the replenishment, the microcomputer 10' moves the plate 21 downward until the first sheet sensor 31 does not detect the sheets as shown in FIGS. 10C and 10D.

Every time the sheet stacker 2 is replenished with sheets, the plate 21 descents a distance corresponding to thickness of the replenished sheets. Accordingly, the replenished sheets are positioned precisely by the front guiding plate 22 and the vertical surfaces 41A to 41C. Thus the sheets on the plate 21 are positioned precisely, although there exist clearances K1 to K3 between the sheets and the slant surface 42A to 42C.

The plate detect sensor 32 is adapted to detect the plate 21 reaching at a lowest point of a movable range. When the plate detect sensor detects the plate 21, the microcomputer 10' does not move the plate 21 downward even if the first sheet sensor 31 detects the sheets. This is because further descent of the plate 21 causes components such as motor to be damaged.

In the LCC according to the second embodiment, it is unlikely that the sheets is damaged while the plate is moving upward or downward by friction between the sheets and a guiding plates 23', 24', and 55.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of feeding sheets to a sheet processing apparatus, comprising:

positioning a first guiding member adapted to move on a stacking plate along a width dimension thereof perpendicular to a sheet feeding direction and to rotate around a vertical axis, the first guiding member having a vertical guiding surface for positioning sheets disposed on the stacking plate;

adjusting an angle of the vertical guiding surface on the stacking plate at an angle with the sheet feeding direction using an angle adjustment mechanism, the angle adjustment being independent from movement of the first guiding member along the width dimension; and stacking sheets on the stacking plate, the sheets being to be fed into the sheet processing apparatus;

wherein positioning the first guiding member does not adjust the angle of the vertical guiding surface;

wherein the first guiding member includes a slant surface at a lower portion adjacent to the stacking plate, the slant surface being disposed in such a manner that the distance between the slant surface and the sheets increases downward.

2. The method of claim 1, wherein: adjusting the angle of the vertical guiding surface comprises:

rotating a knob, the knob being connected to an end portion of a vertical shaft, the shaft having an eccentric cam mounted thereon adapted to make sliding contact with the first guiding member at a second surface of the first guiding member opposite to the vertical guiding surface.

3. The method of claim 1, further comprising:

positioning a second guiding member adapted to position side edges of sheets disposed on the stacking plate in a width dimension of the stacking plate perpendicular to a sheet feeding direction, wherein the second guiding member includes a slant surface at a lower portion thereof, the slant surface being disposed in such a manner that the distance between the slant surface and the sheets increases downward.

4. A sheet feeding device for feeding a sheet to a sheet processing apparatus, the sheet feeding device comprising:

a stacking plate adapted for sheets to be stacked thereon, the sheets being to be fed into the sheet processing apparatus;

a first guiding member adapted to move on the stacking plate along a width dimension thereof perpendicular to a sheet feeding direction and to rotate around a vertical axis, the first guiding member having a vertical guiding surface for positioning sheets disposed on the stacking plate; and an angle adjustment mechanism, that adjusts an angle of the vertical guiding surface with respect to the sheet feeding direction, the angle adjustment being independent from movement of the first guiding member along the width dimension, adjacent to the stacking plate wherein the first guiding member includes a slant surface at a lower portion and the vertical guiding surface at a top portion thereof, the slant surface being disposed at a non-perpendicular angle with respect to the stacking plate in such a manner that a distance between the slant surface and the sheets is increasing downward.

5. The sheet feeding device according to claim 1, wherein the angle adjustment mechanism includes:

a cam mounted on a vertical shaft, the cam having a profile adapted to make sliding contact with the first guiding member at a second surface of the first guiding member opposite to the guiding surface;

a knob for rotating the vertical shaft, the knob being mounted on the vertical shaft; and an urging member adapted to urge the first guiding member against the cam.

6. The sheet feeding device according to claim 4, wherein the stacking plate being movable along a vertical axis while the stacking plate is held in a horizontal position.

7. The sheet feeding device according to claim 6, further comprising a third guiding member adapted to position rear edges of sheets disposed on the stacking plate, wherein the third guiding member includes a slant surface at a lower portion thereof, the slant surface being disposed in such a manner that a distance between the slant surface and the sheets is increasing downward.

8. The sheet feeding device according to claim 7, wherein the third guiding member includes a vertical surface at a top portion thereof.

9. An image forming apparatus, comprising:

the sheet feeding device of claim 6;

an image forming section for forming an image on a sheet fed from the sheet feeding device;

a sheet feeding path for transport a sheet from the sheet feeding device to the image forming section.

10. The sheet feeding device according to claim 1, further comprising a positioning mechanism adapted to position the first guiding member at predetermined locations in the width dimension corresponding to different standard sheet sizes.

11. The sheet feeding device according to claim 10, wherein the positioning mechanism includes:

a horizontal plate connected to the first guiding member, the horizontal plate having an opening portion for engaging with the first guiding member at the predetermined locations;

one or more pins being adapted to slide in the opening portion with a bottom portion of each pin secured to a frame of the sheet feeding device; and a lock plate adapted to engage with top portions of the one or more pins protruding from the opening portion, in such a manner that the horizontal plate is juxtaposed between the frame and the lock plate and is movable horizontally;

wherein the opening portion includes an elongated opening and a plurality of holes, the elongated opening being placed along the width dimension of the stacking plate, the holes being connected to the elongated opening and placed at the predetermined locations for engaging with the first guiding member.

12. The sheet feeding device according to claim 11 wherein the positioning mechanism has an auxiliary positioning mechanism adapted to position the first guiding member at a predetermined auxiliary location, in the width dimension, the predetermined auxiliary location corresponding to a predetermined sheet size that is less frequently used than the different standard sheet sizes.

13. An image forming apparatus, comprising:

the sheet feeding device of claim 4;

an image forming section for forming an image on a sheet fed from the sheet feeding device;

a sheet feeding path for transport a sheet from the sheet feeding device to the image forming section.

14. A sheet feeding device for feeding a sheet to a sheet processing apparatus, the sheet feeding device comprising:

a stacking plate adapted for sheets to be stacked thereon, the sheets being to be fed into the sheet processing apparatus;

a pair of first guiding members adapted to move on the stacking plate along a width dimension thereof perpendicular to a sheet feeding direction, and to rotate around a vertical axis, each of the first guiding members having a vertical guiding surface for positioning the side edges of sheets disposed on the stacking plate; and an angle adjustment mechanism, that adjusts an angle of the vertical guiding surfaces with respect to the sheet feeding direction, the angle adjustment being independent from movement of the first guiding member alone the width dimension, wherein the first guiding members are secured to a first rack gear and a second rack gear, respectively, and the first rack gear and the second rack gear are connected to each other through a pinion gear meshed with both of the first rack gear and the second rack gear, and wherein each first guiding member includes a slant surface at a lower portion adjacent to the stacking plate and a vertical guiding surface at a top portion thereof, the slant surface being disposed at a non-perpendicular angle with respect to the stacking plate in such a manner that a distance between the slant surface and the sheets is increasing downward.

15. A sheet feeding device for feeding a sheet to a sheet processing apparatus, the sheet feeding device comprising:

a stacking plate adapted for sheets to be stacked thereon, the sheets being to be fed into the sheet processing apparatus;

a first guiding member adapted to move on the stacking plate along a width dimension thereof perpendicular to a sheet feeding direction and to rotate around a vertical axis, the first guiding member having a vertical guiding surface for positioning sheets disposed on the stacking plate;

an angle adjustment mechanism, that slants the vertical guiding surface at an angle with the sheet feeding direction; and a positioning mechanism adapted to position the first guiding member at predetermined locations in the width dimension corresponding to different standard sheet sizes, the positioning mechanism comprising:

a horizontal plate connected to the first guiding member, the horizontal plate having an opening portion for engaging with the first guiding member at the predetermined locations;

one or more pins being adapted to slide in the opening portion with a bottom portion of each pin secured to a frame of the sheet feeding device; and a lock plate adapted to engage with top portions of the one or more pins protruding from the opening portion, in such a manner that the horizontal plate is juxtaposed between the frame and the lock plate and is movable horizontally, wherein the opening portion includes an elongated opening and a plurality of holes, the elongated opening being placed along the width dimension of the stacking plate, the holes being connected to the elongated opening and placed at the predetermined locations for engaging with the first guiding member; and wherein the first guiding member includes a slant surface at a lower portion adjacent to the stacking plate and the vertical guiding surface at a top portion thereof, the slant surface being disposed in such a manner that a distance between the slant surface and the sheets is increasing downward.

* * * * *